US011052666B2

(12) United States Patent
Alvarez et al.

(10) Patent No.: US 11,052,666 B2
(45) Date of Patent: Jul. 6, 2021

(54) PRINTHEAD CARRIAGES WITH MECHANICAL PROTECTORS

(71) Applicant: HEWLETT-PACKARD DEVELOPMENT COMPANY, L.P., Spring, TX (US)

(72) Inventors: Jose Antonio Alvarez, Sant Cugat del Valles (ES); Jonathan de la Rubia, Sant Cugat del Valles (ES); Diego Lopez Ubieto, Sant Cugat del Valles (ES)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/487,342

(22) PCT Filed: Jun. 1, 2017

(86) PCT No.: PCT/US2017/035382
§ 371 (c)(1),
(2) Date: Aug. 20, 2019

(87) PCT Pub. No.: WO2018/222194
PCT Pub. Date: Dec. 6, 2018

(65) Prior Publication Data

US 2020/0061999 A1 Feb. 27, 2020

(51) Int. Cl.
*B41J 2/175* (2006.01)
*B41J 25/34* (2006.01)
(Continued)

(52) U.S. Cl.
CPC ..... *B41J 2/1752* (2013.01); *B41J 2/01* (2013.01); *B41J 2/17526* (2013.01);
(Continued)

(58) Field of Classification Search
CPC ..... B41J 2/01; B41J 2/1752; B41J 2/17526; B41J 2/17553; B41J 2/2146; B41J 25/34
See application file for complete search history.

(56) References Cited

U.S. PATENT DOCUMENTS 5,796,417 A 8/1998 Nobel et al.
6,367,918 B1 4/2002 Heiles et al.
(Continued)

FOREIGN PATENT DOCUMENTS

CN 1654216 8/2005
CN 101600577 12/2009
(Continued)

*Primary Examiner* — Anh T Vo
(74) *Attorney, Agent, or Firm* — HP Inc. Patent Department

(57) ABSTRACT

In an example, a printhead carriage to be used in a printing system is disclosed herewith wherein the carriage includes a pocket defined by a first wall and a second wall opposite to the first wall; a set of electrical connectors provided on the first wall; and a mechanical protector. In an example, the mechanical protector may be a sheet with a determined length that extends from the first wall into the pocket and a width that extends along the width of the first wall over the electrical connectors. In an example, the mechanical protector includes an elastic member biased towards the second wall.

19 Claims, 3 Drawing Sheets

(51) Int. Cl.
*B41J 2/01* (2006.01)
*B41J 2/21* (2006.01)

(52) U.S. Cl.
CPC ..... *B41J 2/17553* (2013.01); *B41J 2/2146* (2013.01); *B41J 25/34* (2013.01)

(56) References Cited

U.S. PATENT DOCUMENTS

| | | | | |
|---|---|---|---|---|
| 7,032,994 | B2 * | 4/2006 | O'Hara | B41J 2/1753 347/50 |
| 7,237,883 | B2 * | 7/2007 | Hashii | B41J 2/1753 347/86 |
| 7,284,832 | B2 * | 10/2007 | Kang | B41J 2/1752 347/50 |
| 7,484,825 | B2 * | 2/2009 | Asauchi | B41J 2/17503 347/19 |
| 7,717,549 | B2 | 5/2010 | Rademakers et al. | |
| 7,891,771 | B2 * | 2/2011 | Nakano | H01R 12/714 347/50 |
| 8,215,751 | B2 | 7/2012 | Petruchik et al. | |
| 8,220,902 | B2 | 7/2012 | Petruchik et al. | |
| 9,233,547 | B2 | 1/2016 | Mizutani et al. | |
| 2017/0057264 | A1 | 3/2017 | Quintero et al. | |

FOREIGN PATENT DOCUMENTS

| | | | |
|---|---|---|---|
| CN | 105313468 | | 2/2016 |
| EP | 1018436 | B1 | 2/2003 |
| GB | 2299303 | A | 10/1996 |
| JP | H-07314660 | | 12/1995 |
| JP | 2001315408 | | 11/2001 |
| JP | 2008207378 | | 9/2008 |
| JP | 2009292144 | | 12/2009 |
| JP | 2016005887 | | 1/2016 |
| WO | WO-2015185160 | A1 | 12/2015 |

* cited by examiner

PRINTHEAD CARRIAGES WITH MECHANICAL PROTECTORS

BACKGROUND

In printers, a set of printheads are located in a carriage, and are provided to contact a pen pocket base wherein such printhead is to remain in a fix position. In order to make the position of the printhead unique, accurate and repeatable, the printhead should be mechanically connected to reference surfaces called datum surfaces. This is particularly relevant wherein the printer is a wide-format printer.

To ensure this mechanical connection in the vertical (longitudinal) direction, a latch may be provided to exert a vertical force on the printhead towards the base of the carriage, to ensure a mechanical a physical connection between the printhead and the datum surfaces. In the transversal direction, the electrical connectors often take the role of maintaining the printhead on its position.

DETAILED DESCRIPTION

Forces exerted on a printhead may have negative effects on the carriage and/or on its internal elements such as, e.g., the electric connections or electric pins. Therefore, mechanical protectors of such electric connections may be provided in order to prevent the insertion/removal forces exerted on printheads from damaging the electrical connectors within the carriage. In addition, external forces that may occur during printing such as, e.g., the printhead colliding with an obstacle on the print substrate, may move the printhead away from the datum surfaces and, in consequence, disconnect or bend at least some of the electrical connections.

Mechanical protectors that protect electric connections and dampen unwanted movements of the printhead away from the datum surfaces within the carriage may be provided.

Figure 1:
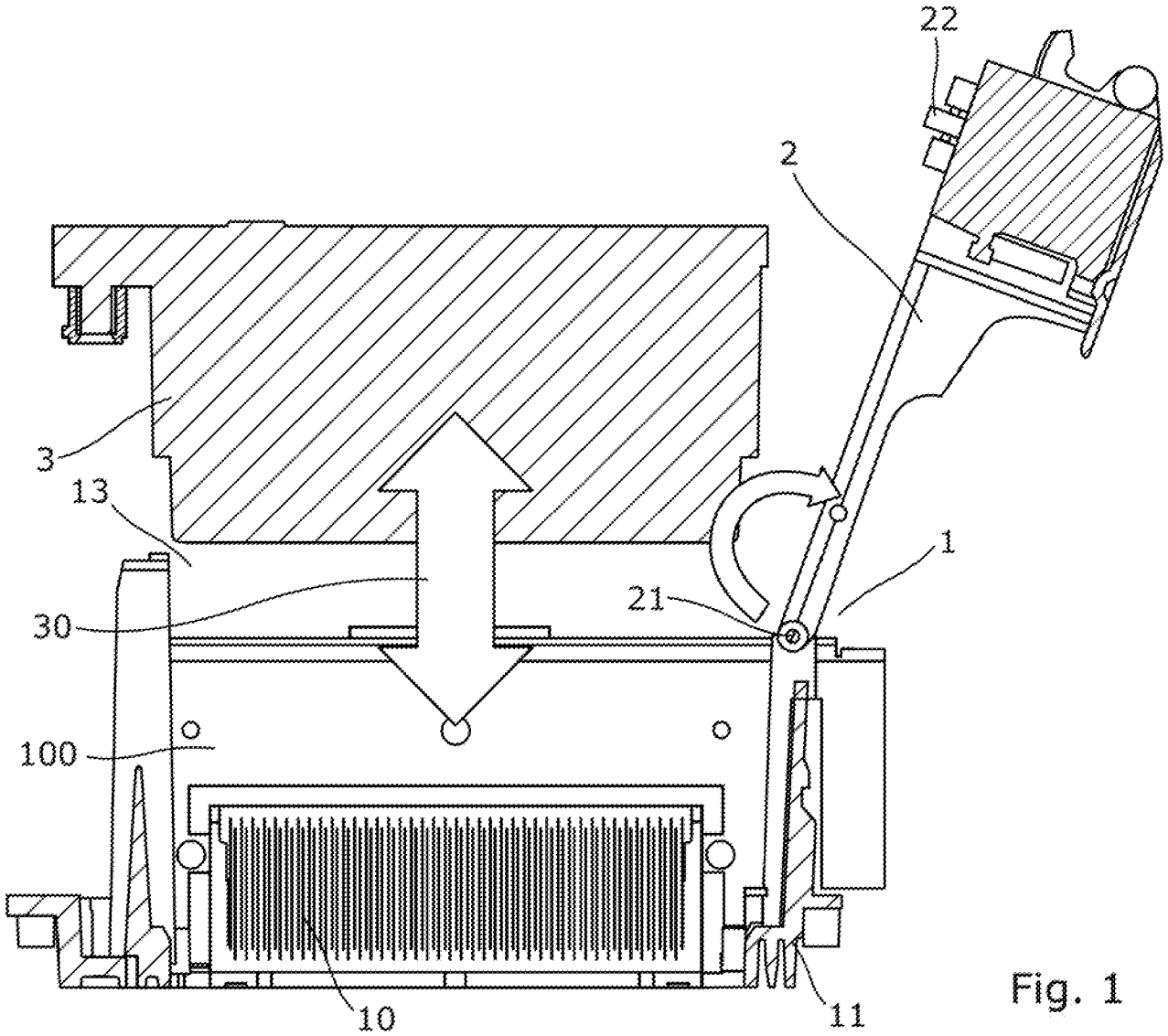
FIG. 1 is a schematic view of an example of a printhead carriage with a printhead being inserted.

FIG. 1 shows an example of printhead carriage 1 comprising a latch 2 provided with a rotatable connection 21 to the carriage 1 that allows the latch to rotatably move between an open position, wherein the latch allows the insertion of a printhead 3 through an input opening towards a pocket 13, and a closed position, wherein the latch closes, at least partially, the input opening 13. Additionally, the latch 2 may comprise mechanical actuators to push a printhead downwards, i.e., towards the base 11 of the carriage 1 while on the closed position, for example, by spring-like elements. Also, the latch 2 may include a locking mechanism 22 to lock the latch on the closed position.

Furthermore, the carriage 1 may comprise electric connections 10 to communicate with the printhead 3. Such electric connections 10 are often flexible pins that project from a first wall 100 of the carriage 1. The flexible pins are often bent copper strips that are biased away from the first wall 100 of the carriage 1 so that, upon insertion of the printhead 3 in an insertion direction 30, the flexible pins exert a connecting force towards another electrical connector, such as a set of electric pads, provided on the printhead.

These electric connectors 10 can be easily damaged since they are often fragile metallic strips. Also, their protrusion from the side wall may make them vulnerable to mechanical forces due to incorrect insertion/removal of the print head 3 or a deformation of the printhead, e.g., due to temperature or a collision. These protruding connectors are also susceptible to dust or liquids that may enter the carriage through the input opening.

Figure 2:
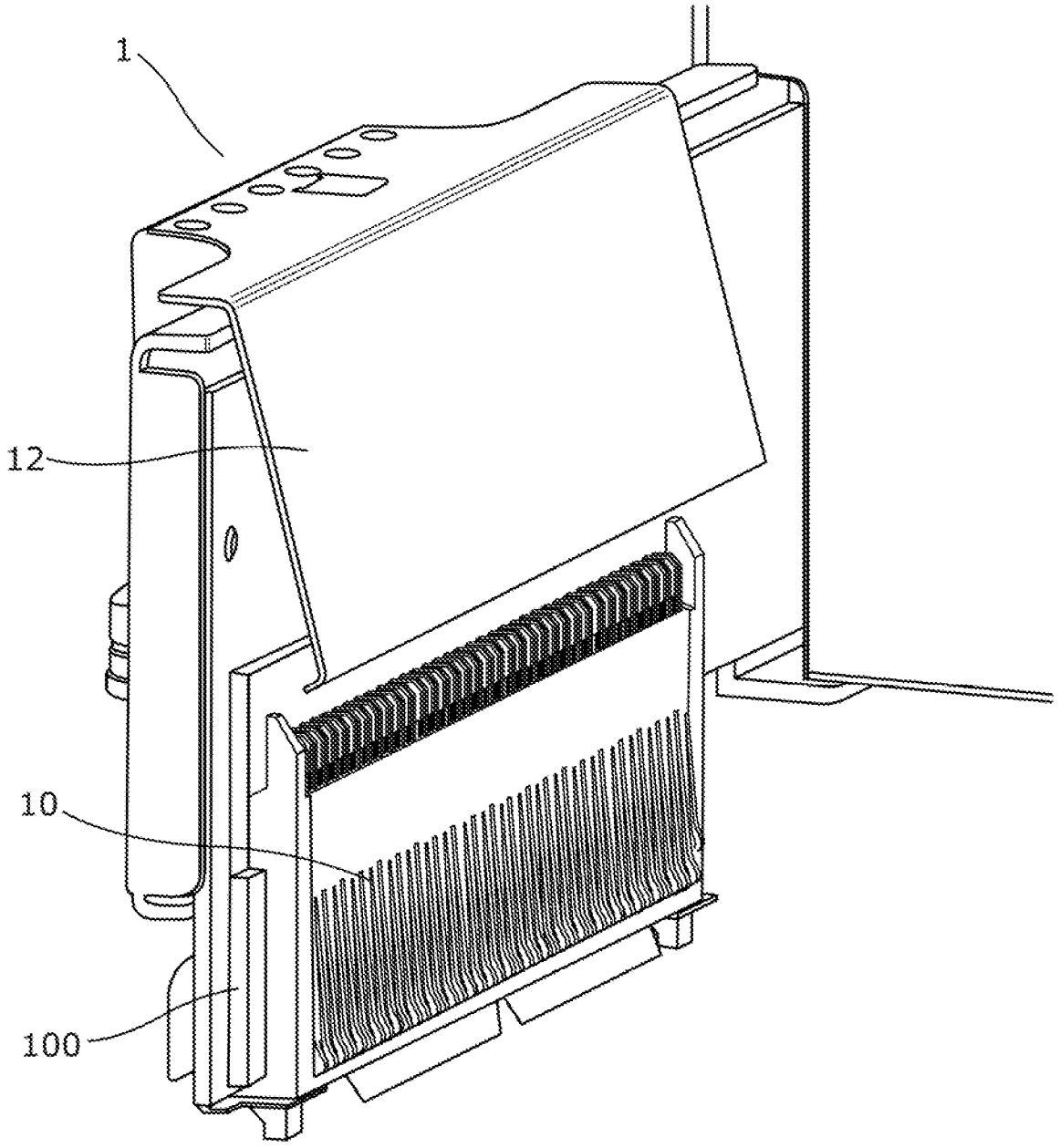
FIG. 2 is an example of mechanical protector for the electric connections of the printhead carriage.

FIG. 2 shows an example of a mechanical protector 12 that may be provided on the carriage 1. In the example of FIG. 2, the mechanical protector 12 is a sheet attached to the first wall 100 and bent forming an acute angle with the first wall 100. The mechanical protector 12 covers at least part of the area above the electrical connectors 10 thereby protecting the connectors from dust or liquids entering through the inlet opening. In an example, the mechanical protector may be a metallic sheet.

In the example of mechanical protector 12 of FIG. 2, the bend provides a biasing effect so that, upon the presence of a printhead 3, the mechanical protector 12 is deformed and by an elastic movement pushes the printhead 3 away from the first wall 100 and pushes the electric connectors 10 towards a second wall 200 opposite to the first wall 100. The elastic movement exerts a force on the printhead that protects the electric connections 10 and maintains the printhead 3 fixed within the carriage at a determined distance which may be dimensioned to allow a contact between the electric connectors 10 and their counterparts in the printhead without exerting an excessive force on the electric connectors 10.

In another example, the mechanical protector 12 may be an elongated element that extends over at least part of the electrical connector 10 and substantially parallel to it. Such elongated element may be, e.g., an element that deforms or compresses upon the presence of a printhead 3 on the carriage 1 like a foam or a plastic.

Furthermore, the mechanical protector 12 may be made from a flexible material and/or may comprise a spring-like element biased in a direction with a perpendicular component to the first wall 100.

Figure 3:
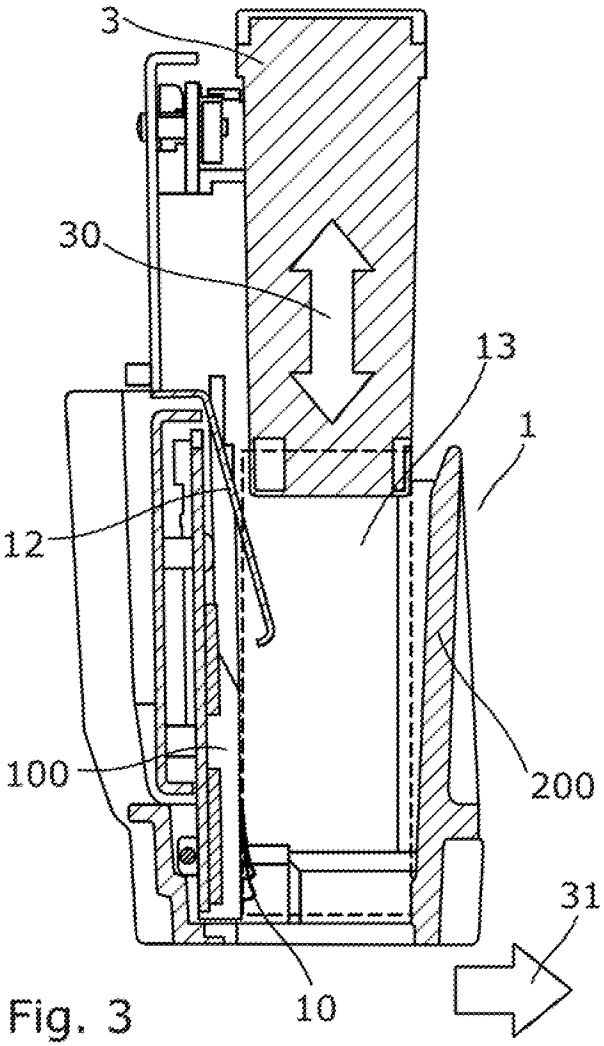
FIG. 3 shows a side view of an example of printhead carriage.

FIG. 3 shows a side view of an example of a carriage. In FIG. 3 it can be seen that the first wall 100 and/or the second wall 200 may be adapted to receive the printhead 2 into a pocket 13 defined by the first wall 100 and the second wall 200 by sliding it along their length. The printhead 3 may slide downwards from the input opening in an insertion direction 30 from the top of the first wall 100 and/or the second wall 200 towards a pocket base located in the lower half of the first wall 100 and/or the second wall 200.

The provision of a printhead 3 within the pocket 13 causes the mechanical protector 12 to deform and, given the elastic properties of the mechanical protector, an elastic force is exerted on the printhead pushing it towards the second wall 200. Furthermore, the mechanical protector occupies a space between the first wall 100 and the printhead 3 thereby protecting the electrical connectors and, also, helping maintain the printhead in contact with datum surfaces on the carriage and keeping it in a stable position within the pocket.

Also, in an example, the mechanical protector may be provided as to exert an elastic force on the printhead in the printing direction 31 of the printing system. In this particular example, a printhead 3 and/or a carriage 1 may collide with elements, such so as an obstacle on the printing substrate or another element the printing system, while moving along a print direction. The mechanical protector may dampen the effect of such collisions over the carriage and, in particular, over the electric connectors 10 by acting as an intermediate element between the obstacle and the electric connectors 100.

Figure 4:
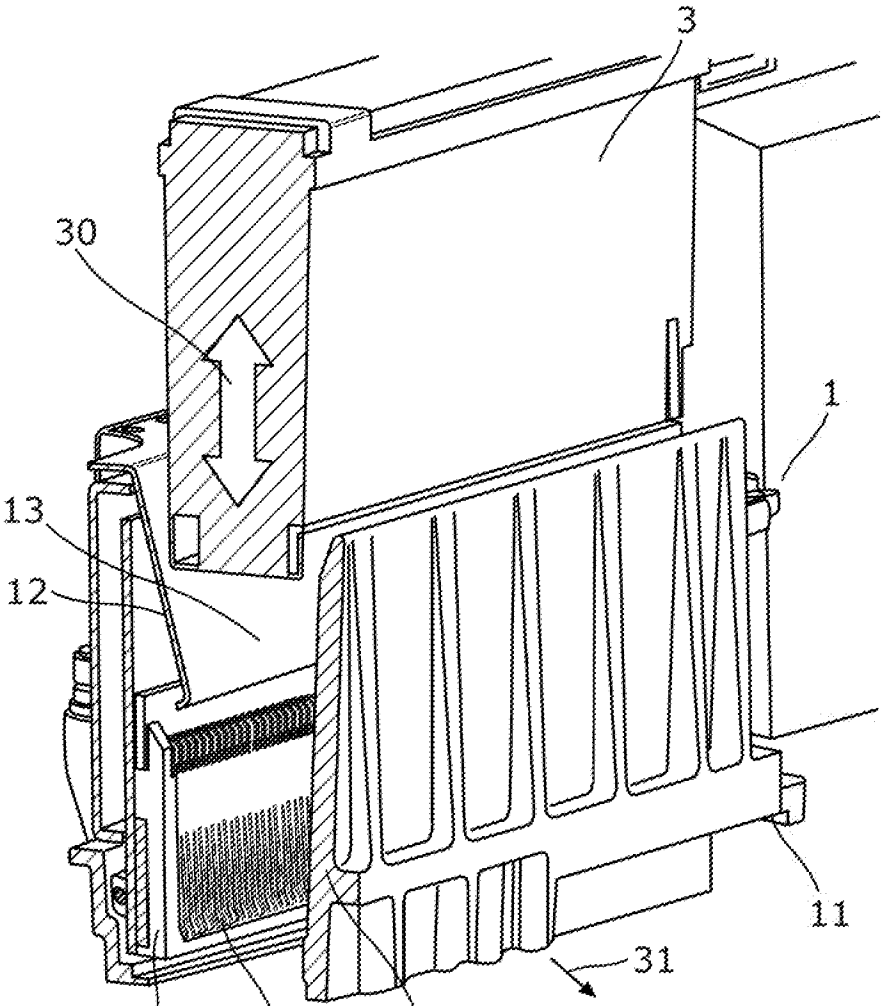
FIG. 4 shows an isometric view of the printhead carriage of FIG. 3.

FIG. 4 shows an isometric view of the example of carriage of FIG. 3. In FIG. 4, it can be seen that the electrical connectors 10 may be located in the lower portion of the first wall 100 and may be provided substantially along most of the width of the first wall 100. The mechanical protector 12 may be located along the width of the first wall 100 and/or over the electrical connector 100 or, at least over a part of the electrical connector 100. In a further example, such electrical connector 100 may be provided along part of the width of the first wall 100, and the protector may be located over all of the electrical connector 100 and along most of the width of the first wall or, at least extending along 50% of the width of the first wall 100.

In essence, a printhead carriage is disclosed, wherein such carriage comprises:

a pocket to receive a printhead comprising a first wall and a second wall opposite to the first wall or on the opposite side of the pocket;

a set of electrical connectors provided on the first wall; and a mechanical protector;

the mechanical protector being a sheet with a length that extends from the first wall into the pocket and a width that extends along the width of the first wall over the electrical connectors, the mechanical protector further comprising an elastic member biased towards the second wall.

In an example, the mechanical protector is a sheet and the elastic member is a bend performed on the sheet forming an acute angle with the first wall. The mechanical protector may be a metallic sheet.

In a further example the mechanical protector is provided over, at least, a part of the first wall comprising the electrical connectors. Alternatively, the mechanical protector may extend along, at least, 50% of the width of the first wall.

The mechanical protector may extend from the first wall with a component (a vectorial component of a vector describing the direction of extension) in a printing direction in order to provide a dampening effect to collisions in the printing direction such as, e.g., hitting an obstacle on the substrate or other parts of a printing system Furthermore, the second wall comprises at least one datum surface to contact with a printhead wherein the printhead comprises counterpart surfaces to contact such datum surfaces.

In another example, the pocket may be adapted to receive a printhead by sliding it along the length of the first and/or the second wall into the pocket. Also, the mechanical protector is located on top of the first wall thereby helping to guide the printhead away from the electrical connectors.

On the other hand, a printing system is disclosed, such printing system being adapted to receive a printhead in a carriage wherein the carriage further comprises:

a pocket to receive the printhead carriage along the length of a first wall and/or a second wall opposite to the first wall;

a set of electrical connectors provided on the first wall; and a mechanical protector;

wherein the mechanical protector has a length and a width. The mechanical protector may extend along its length into the pocket and its width extending along a portion of the width of the first wall located at least partly over the electrical connectors. Also, it should be noted that the pocket is defined by a space between the first and the second wall.

In an example, the mechanical protector may be a sheet and may comprise an elastic member biased in a direction away from the first wall. Alternatively, the mechanical protector may be a flexible sheet bent as to form an acute angle with the first wall.

Furthermore, the mechanical protector may comprise a spring-like element biased in a direction away from the first wall.

In another example, the mechanical protector may comprise a push element to push the printhead in a direction towards the second wall.

The invention claimed is:

1. A printhead carriage comprising:

a pocket to receive a printhead comprising a first wall and a second wall opposite to the first wall;

a set of electrical connectors provided on the first wall; and a mechanical protector;

wherein the mechanical protector extends from the first wall further into the pocket than the set of electrical connectors, and wherein the mechanical protector comprises an elastic member biased to urge the printhead, when fully inserted in the pocket, towards the second wall.

2. A printhead carriage, according to claim 1, wherein the mechanical protector is a sheet with a width that spans a width of the set of electrical connectors, and the elastic member is a bend on the sheet.

3. A printhead carriage, according to claim 2, wherein the sheet is arranged to shield the set of electrical connectors from dust or liquid entering the pocket.

4. A printhead carriage, according to claim 1, wherein the mechanical protector is provided over a part of the first wall and above the electrical connectors in an insertion direction of the printhead into the pocket.

5. A print head carriage, according to claim 1, wherein a width of the mechanical protector extends along, at least, 50% of a width of the first wall.

6. A printhead carriage, according to claim 1, wherein the mechanical protector extends from the first wall with a component in a printing direction.

7. A printhead carriage, according to claim 1, wherein the mechanical protector is a metallic sheet.

8. A printhead carriage, according to claim 1, wherein the second wall comprises at least one datum surface to contact with a printhead.

9. A printhead carriage, according to claim 1, wherein the mechanical protector extends at an increasing distance into the pocket from the first wall along an insertion direction of the printhead into the pocket until a distal end of the mechanical protector comprises a bend back toward the first wall.

10. A printhead carriage, according to claim 1, wherein the mechanical protector is located on top of the first wall.

11. A printhead carriage, according to claim 1, wherein the set of electrical connectors are arranged to extend into the pocket to make electrical contact with the printhead, when inserted in the pocket, the mechanical protector to protect the electrical connectors.

12. A printhead carriage, according to claim 11, wherein the set of electrical connectors comprise a number of flexible pins that exert a connecting force towards the printhead in addition to the elastic member biased to urge the printhead, when fully inserted in the pocket, towards the second wall.

13. A printhead carriage, according to claim 1, wherein the elastic member is arranged to assert pressure on the printhead, when inserted in the pocket, toward to the second wall at a location above the set of electrical connectors and in a direction laterally across the pocket and away from the set of electrical connectors.

14. A printhead carriage, according to claim 1, wherein the mechanical protector comprises compressible foam.

15. A printing system to receive a printhead in a carriage, wherein the carriage further comprises:

a pocket to receive the printhead between a first wall and a second wall, wherein the second wall is opposite to the first wall;

a set of electrical connectors provided on the first wall; and a mechanical protector;

wherein the mechanical protector is disposed between a mouth of the pocket through which the printhead is inserted and the electrical connectors on a lower portion of the first wall that is spaced away from the mouth of the pocket, the mechanical protector thus positioned for preventing damage caused by insertion of the printhead to the electrical connectors;

wherein the mechanical protector comprises compressible foam.

16. A printhead carriage comprising:

a pocket to receive a printhead comprising a first wall and a second wall opposite to the first wall;

a set of electrical connectors provided on the first wall and extending into the pocket so as to make electrical contact with contact pads on the printhead when the printhead is installed in the pocket; and a mechanical protector to protect the electrical connectors, the mechanical protector disposed above the set of electrical connectors along an insertion direction of the printhead into the pocket;

wherein the mechanical protector extends from the first wall at an angle such that the mechanical protector extends further away from the first wall along the insertion direction of the printhead into the pocket;

wherein insertion of the printhead into the pocket bends the mechanical protector toward the first wall such that the mechanical protector exerts a pressure on the printhead, when fully inserted in the pocket, toward the second wall opposite to the first wall.

17. The printhead carriage of claim 16, wherein the second wall is disposed ahead of the first wall in a printing direction of the printhead carriage such that the mechanical protector extends in the printing direction away from the first wall and toward the second wall.

18. The printhead carriage of claim 16, wherein the mechanical protector extends at an increasing distance into the pocket from the first wall along the insertion direction of the printhead into the pocket until a distal end of the mechanical protector comprises a bend that is turned back toward the first wall.

19. The printhead carriage of claim 16, wherein the mechanical protector has a profile above the first wall that permits contact between the electrical connectors on the first wall and corresponding connectors on a printhead despite the pressure on the printhead away from the first wall.

* * * * *